US010438547B2

(12) United States Patent
Ozaki

(10) Patent No.: US 10,438,547 B2
(45) Date of Patent: Oct. 8, 2019

(54) DISPLAY DEVICE

(71) Applicant: Japan Display Inc., Minato-ku (JP)

(72) Inventor: Tadafumi Ozaki, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 15/371,571

(22) Filed: Dec. 7, 2016

(65) Prior Publication Data

US 2017/0169772 A1 Jun. 15, 2017

(30) Foreign Application Priority Data

Dec. 9, 2015 (JP) ..... 2015-240208

(51) Int. Cl.
*G09G 3/34* (2006.01)
*G09G 3/36* (2006.01)

(52) U.S. Cl.
CPC ..... *G09G 3/3607* (2013.01); *G09G 3/3406* (2013.01); *G09G 3/3648* (2013.01); *G09G 2320/029* (2013.01); *G09G 2320/0242* (2013.01); *G09G 2320/0276* (2013.01); *G09G 2320/0666* (2013.01); *G09G 2320/103* (2013.01); *G09G 2340/06* (2013.01); *G09G 2340/16* (2013.01)

(58) Field of Classification Search
None
See application file for complete search history.

(56) References Cited

U.S. PATENT DOCUMENTS

2013/0027441 A1* 1/2013 Kabe ..... G09G 3/3413 345/690
2013/0194295 A1* 8/2013 Chan ..... G09G 3/3466 345/619
2014/0168284 A1 6/2014 Kabe et al.
2014/0218386 A1 8/2014 Tatsuno et al.
2014/0285539 A1 9/2014 Kurokawa et al.
2014/0292840 A1 10/2014 Harada et al.
2015/0109350 A1 4/2015 Gotoh et al.
2015/0310830 A1 10/2015 Ikeda et al.
2015/0339966 A1* 11/2015 Harada ..... G06T 1/20 345/605

(Continued)

FOREIGN PATENT DOCUMENTS

JP 2014-139647 7/2014
JP 2014-155024 8/2014

(Continued)

*Primary Examiner* — Yanna Wu
(74) *Attorney, Agent, or Firm* — Oblon, McClelland, Maier & Neustadt, L.L.P.

(57) ABSTRACT

A display device includes a display panel and a processor. The panel has pixels including first to fourth sub-pixels. The processor determines candidates for an expansion coefficient of pixels when displaying an image of one frame, determines the coefficient for the one frame, based on each candidate, calculates the output values of a pixel, based on the coefficient and the input values of the pixel, and outputs the output values to the panel. The processor calculates a candidate for the coefficient in the second frame of a pixel, when the input values of this pixel are not substantially the same between first and second frames, and calculates no candidate for the coefficient when the input values of the pixel are substantially the same between the first and second frames.

15 Claims, 9 Drawing Sheets

(56) References Cited

U.S. PATENT DOCUMENTS

| | | | | |
|---|---|---|---|---|
| 2015/0356933 | A1* | 12/2015 | Kabe | G09G 3/3607 345/694 |
| 2016/0049123 | A1* | 2/2016 | Jeong | G09G 3/3607 345/690 |

FOREIGN PATENT DOCUMENTS

| | | |
|---|---|---|
| JP | 2014-186245 | 10/2014 |
| JP | 2014-191338 | 10/2014 |
| JP | 2015-82024 | 4/2015 |
| JP | 2015-210388 | 11/2015 |

* cited by examiner

DISPLAY DEVICE

CROSS-REFERENCE TO RELATED APPLICATIONS

This application is based upon and claims the benefit of priority from Japanese Patent Application No. 2015-240208, filed Dec. 9, 2015, the entire contents of which are incorporated herein by reference.

FIELD

Embodiments described herein relate generally to a display device.

BACKGROUND

In a display device for displaying color images, one pixel comprises a plurality of sub-pixels, and expresses various colors by causing the sub-pixels to output light of different colors. In this display device, to display an image with a high luminance, it is necessary to increase, for example, the luminance of a backlight, which may increase consumption of power. In order to improve this, there is a technique of adding a white sub-pixel to general red, green and blue sub-pixels. Addition of the white sub-pixel increases the entire luminance, and hence can reduce the luminance of the backlight, with the result that consumption of power can be reduced.

In general, data input to the display device comprises input values of red, green and blue colors. When the white sub-pixel is added to a pixel, it is necessary to generate an output value for the white sub-pixel, based on the input values, and also to generate output values for the sub-pixels of the red, green and blue colors. Thus, the processing load of image display is increased.

DETAILED DESCRIPTION

In general, a display device according to each embodiment includes a display panel and a processor. The display panel has pixels each including first to fourth sub-pixels. The processor determines candidates for an expansion coefficient pixel by pixel when displaying an image of one frame, determines the expansion coefficient for the one frame, based on a respective one of the determined candidates, calculates output values of a respective pixel, based on the determined expansion coefficient and input values of the respective pixel, and outputs the output values to the display panel. Further, the processor calculates a candidate for the expansion coefficient in association with a second frame of the respective pixel when the input values of the respective pixel are not substantially the same between a first frame and the second frame subsequent to the first frame, and calculates no candidate for the expansion coefficient in association with the second frame of the respective pixel when the input values of the respective pixel are substantially the same between the first and second frames.

Some embodiments will hereinafter be described, referring to the accompanying drawings.

The disclosures below are merely examples, and any changes therein that can be easily conceived by anyone skilled in the art without departing the gist of the invention will be included in the scope of the invention. Further, in order to better clarify the description, drawings may more roughly show the width, thickness, shape, etc., of each element than in an actual embodiment. However, these drawings are just examples and do not limit the interpretation of the present invention. In drawings, no reference numbers may be attached to continuously-arranged same or similar elements. Further, in the description and drawings, structural elements having the same or similar functions are denoted by the same reference numbers, and duplication of description thereof may be omitted.

In each embodiment, a liquid crystal display is disclosed as an example of a display device. However, each embodiment does not inhibit application of each technical idea disclosed therein to other types of display devices. Other types of display devices may include, for example, a light-emission type display, such as an organic electroluminescence display, and an electronic-paper-type display having, for example, an electrophoresis element.

First, a description will be given of a configuration shared in the embodiments below.

Figure 1:
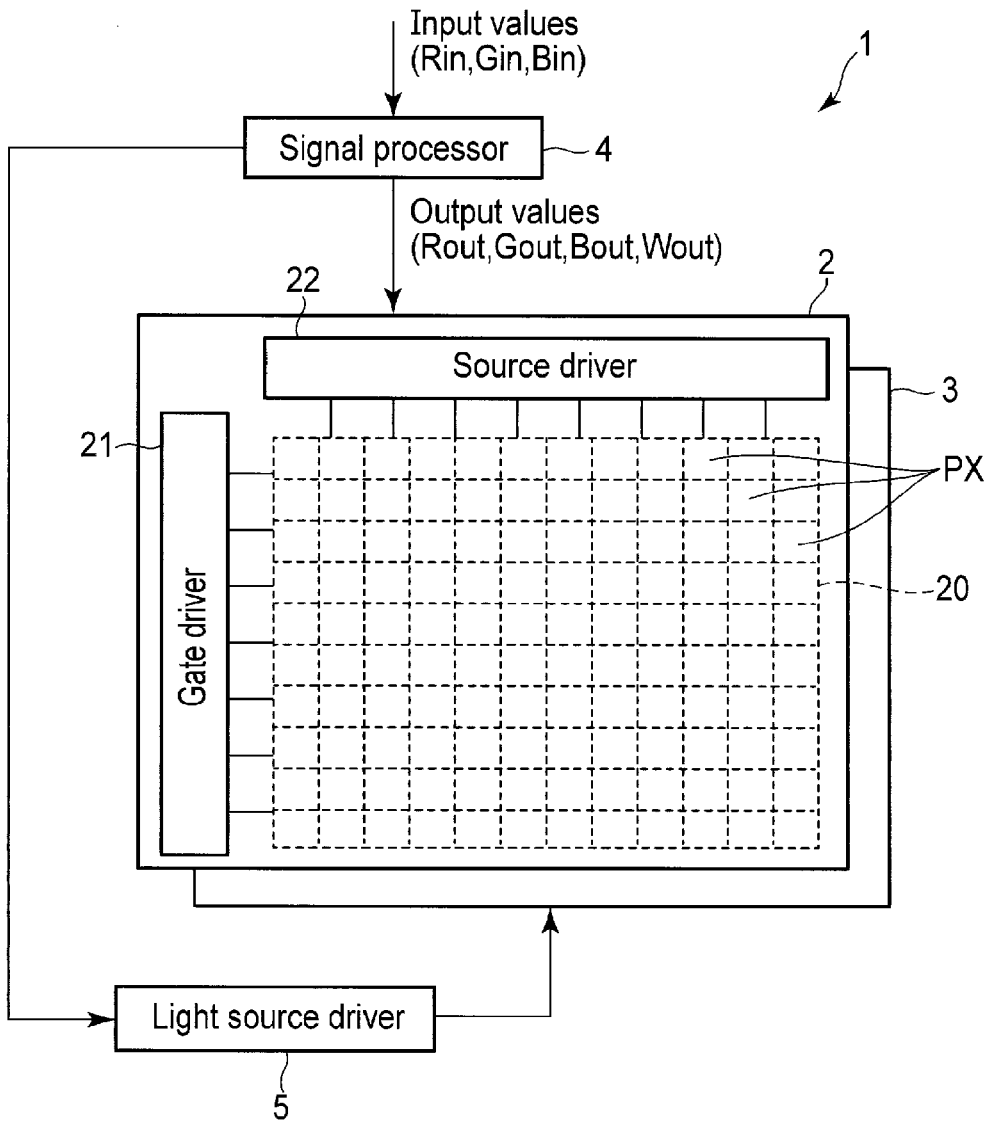
FIG. 1 is a schematic diagram showing the configuration of a liquid crystal display according to each embodiment.

FIG. 1 shows a rough configuration of a liquid crystal display 1 according to each embodiment. The liquid crystal display 1 comprises a display panel 2, a backlight 3, a signal processor 4, and a light source driver 5.

The display panel 2 comprises an array substrate, a counter-substrate opposing the array substrate, and a liquid crystal layer sealed between the array substrate and the counter-substrate. The display panel 2 further comprises a display area 20 where a large number of pixels PX are arranged in a matrix, and a gate driver 21 and a source driver 22 for driving each pixel PX. The gate driver 21 and the source driver 22 are formed as a built-in circuit in the display panel 2, for example. The gate driver 21 and the source driver 22 may be formed separately from the display panel 2.

The backlight 3 is provided on the backside (opposite to the display surface) of the display panel 2. The backlight 3 is, for example, a surface light source device, and comprises a light guide plate, and light sources, such as light emitting diodes, arranged along an end of the light guide plate. Light from the light sources is transmitted through the light guide plate opposing the display panel 2, and emitted from the major surface of the display panel 2. Thus, light for displaying images is supplied to the display area 20. The liquid crystal display 1 may employ a front light at the display surface side of the display panel 2, in place of the backlight 3. Furthermore, the liquid crystal display 1 may comprise a structure that enables the reflected light of outside light to be used for display, along with the backlight 3 and the front light.

The liquid crystal display 1 receives image data for displaying an image from the control board of, for example, an electronic device installing the display 1. The image data includes input values (an input signal) indicating the display color of each pixel PX. For example, these input values include a red component Rin, a green component Gin and a blue component Bin.

The signal processor 4 is mounted on, for example, the display panel 2. The signal processor 4 may be connected to the display panel 2 through, for example, a flexible wiring board. The signal processor 4 calculates output values to be supplied to the display panel 2, based on the input values (Rin, Gin, Bin). For instance, these output values correspond to a red component Rout, a green component Gout, a blue component Bout, and a white component Wout.

Further, the signal processor 4 generates a control signal for the light source driver 5, based on input values (Rin, Gin, Bin) or output values (Rout, Gout, Bout, Wout). The light source driver 5 adjusts the luminance of the light source of the backlight 3, based on the control signal. Alternatively, the light source driver 5 may just turn on and off the light source of the backlight 3.

Figure 2:
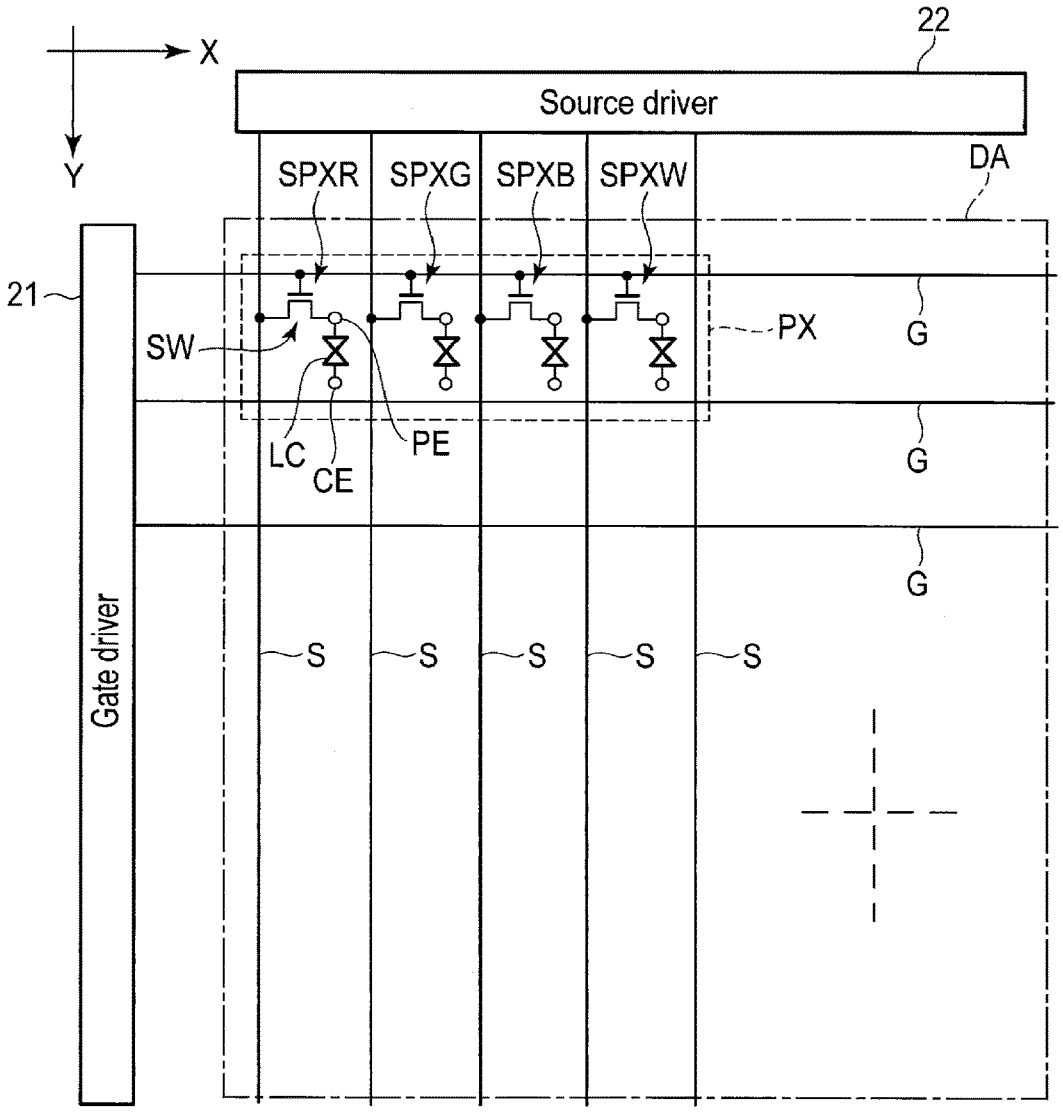
FIG. 2 shows an example of an equivalent circuit for a display panel incorporated in the liquid crystal display.

FIG. 2 shows an example of an equivalent circuit of the display panel 2. The display panel 2 comprises a plurality of scanning lines (also called gate lines) G, and a plurality of signal lines (also called source lines) S that intersect the respective scanning lines G. The scanning lines G extend along a first direction X, and are arrayed along a second direction Y. The signal lines S extend along the second direction Y, and are arrayed along the first direction X. The first and second directions X and Y cross perpendicularly, for example.

In the example of FIG. 2, each area divided by corresponding scanning and signal lines G and S corresponds to one sub-pixel SPX. In this example, a red sub-pixel SPXR (first sub-pixel), a green sub-pixel SPXG (second sub-pixel), a blue sub-pixel SPXB (third sub-pixel), and a white sub-pixel SPXW (the fourth sub-pixel) constitute one pixel PX. Although in the example of FIG. 2, the sub-pixels SPXR, SPXG, SPXB and SPXW are arranged in this order along the first direction X, these sub-pixels SPX may have an arbitrary layout. Moreover, one pixel PX may include a plurality of sub-pixels SPX corresponding to the same color.

Each sub-pixel SPX includes a switching element SW. The switching element SW is a thin-film transistor formed in, for example, the array substrate. The switching element SW is electrically connected to the scanning line G, the signal line S and a pixel electrode PE. The pixel electrode PE generates an electric field that is exerted on a liquid crystal layer LC between the pixel electrode and a common electrode CE formed for the plurality of sub-pixels SPX, when the switching element SW is turned on.

The gate driver 21 sequentially supplies a scanning signal to the scanning lines G. The source driver 22 selectively supplies a video signal to the signal lines S in accordance with the output values (Rout, Gout, Bout, Wout) from the signal processor 4. When a scanning signal has been supplied to a scanning line G connected to a certain switching element SW, and a video signal has been supplied to a signal line S connected to this switching element SW, a voltage corresponding to this video signal is applied to the corresponding pixel electrode PE. By an electric field generated at this time between the pixel electrode PE and the common electrode CE, the alignment of the liquid crystal molecules of the liquid crystal layer LC changes from an initial alignment state assumed when no voltage is applied. By this operation, light from the backlight 3 is selectively transmitted through the display panel 2, thereby displaying an image on the display area 20.

Red, green, blue and white (or transparent) color filters are opposed to the sub-pixels SPXR, SPXG, SPXB and SPXW, respectively. This enables light passing through each sub-pixel is colored, thereby realizing color display. The color filters are formed in, for example, the counter substrate. The sub-pixel SPXW may not have a color filter.

Then, the signal processor 4 will now be described in detail.

Figure 3:
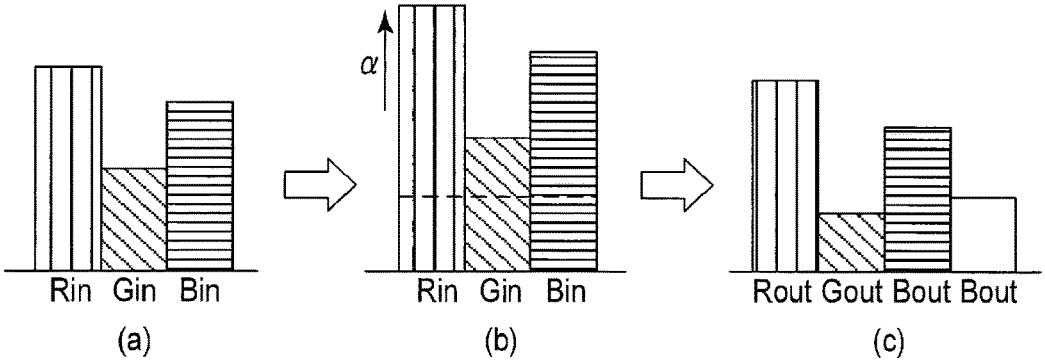
FIG. 3 is a schematic diagram, showing output value generation by a signal processor incorporated in the liquid crystal display.

The signal processor 4 performs various types of processing for generating output values (Rout, Gout, Bout, Wout) based on input values (Rin, Gin, Bin). FIG. 3 shows the outline of generation of the output values (Rout, Gout, Bout, Wout). By multiplying the components Rin, Gin and Bin shown in FIG. 3(*a*) by expansion coefficient $\alpha$, the signal processor 4 elongates the components Rin, Gin and Bin as shown in FIG. 3(*b*). Subsequently, the signal processor 4 replaces, with the white component Wout, the common portions of the components Rin, Gin and Bin indicated by the broken line in FIG. 3(*b*). At this time, the signal processor 4 generates the components Rout, Gout and Bout as the output values by reducing, by the component Wout, the components Rin, Gin and Bin obtained after extension. Thus, the output values (Rout, Gout, Bout, Wout) shown in FIG. 3(*c*) are generated.

Figure 4:
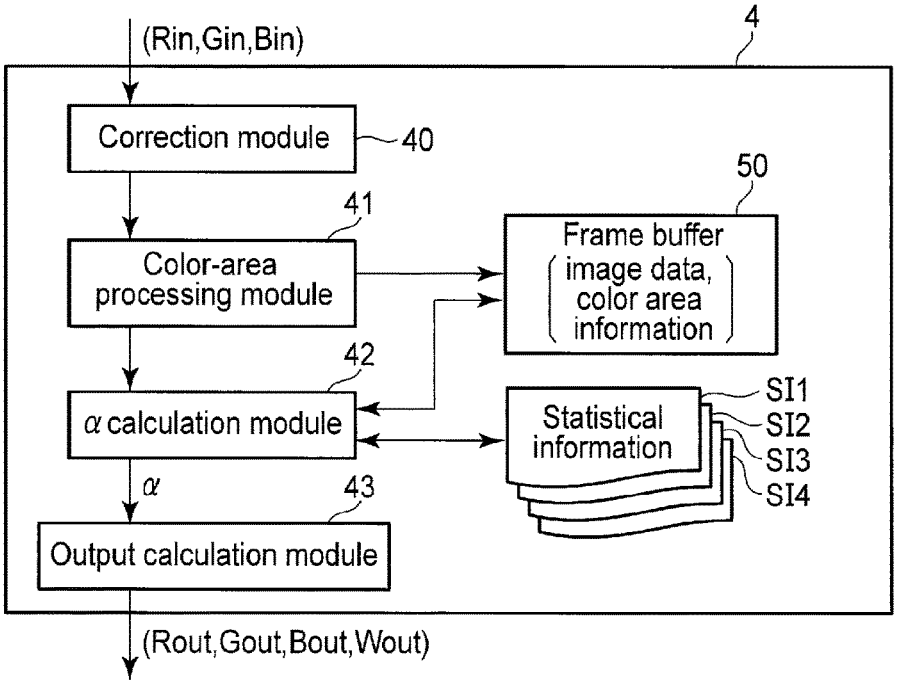
FIG. 4 is a functional block diagram of the signal processor.

Referring now to the functional block diagram of FIG. 4, a description will be given of the configuration of the signal processor 4 for performing the above-described processing. The signal processor 4 comprises a correction module 40, a color-area processing module 41, an $\alpha$ calculation module 42, and an output calculation module 43. The modules 40 to 43 may be realized by software, or by hardware, such as an IC and various circuits. Furthermore, the modules 40 to 43 are presented merely for describing examples of functions of the signal processor 4, and hence a module obtained by integrating part of those modules as one unit or more detailed modules may be defined.

In each embodiment, a case where a $\gamma$ correction is performed in advance on the input values (Rin, Gin, Bin) is assumed as an example. The correction module 40 performs linear conversion as an inverse $\gamma$ correction on the input values (Rin, Gin, Bin). When each of the components Rin, Gin and Bin is, for example, RGB data expressed by 8 bits (0 to 255), the correction module 40 may perform the inverse $\gamma$ correction after normalizing each of the components Rin, Gin and Bin to a value of not less than 0 and not more than 1.

The color-area processing module 41 determines which one of predetermined areas in a preset color space the color expressed by each input value (Rin, Gin, Bin) belongs to. In each embodiment, a case where this color space is a YUV color space is assumed. The YUV color space is a color space defined by a luminance (Y), a color difference (U or Cb) between the luminance and blue color, and a color difference (V or Cr) between the luminance and red color.

Figure 5:
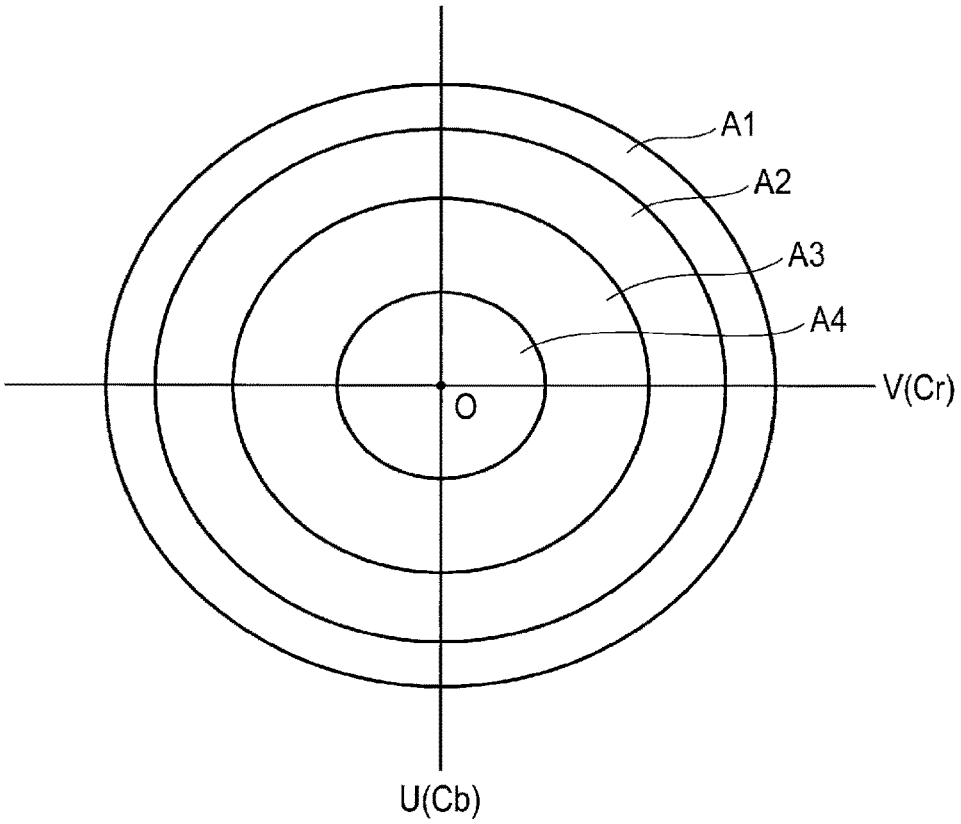
FIG. 5 shows a definition example of areas in a YUV color space.

FIG. 5 shows a definition example for areas in the YUV color space. In this example, in the two-dimensional space expressed by the color differences U (Cb) and V (Cr), a first color area A1, a second color area A2, a third color area A3, and a fourth color area A4 are defined. The fourth color area A4 is an area including a starting point O. The third color area A3 is an area surrounding the fourth color area A4. The second color area A2 is an area surrounding the third color area A3. The first color area A1 is an area surrounding the second color area A2. In the example of FIG. 5, the color areas A1 to A4 are concentric circles having the starting point O as their center. An area that is not included in the color areas A1 to A4 may be defined as a fifth color area. Further, the number and/or forms of the color areas are not limited to those shown in FIG. 5, and color areas may be defined in a color space other than the YUV color space.

The color-area processing module 41 writes, to a frame buffer 50, the input values (Rin, Gin, Bin) and color area information that indicates color areas to which colors expressed by the input values belong. The frame buffer 50 is a memory that stores, for example, image data (input values corresponding to each pixel) corresponding to one frame, color area information corresponding to the input values (Rin, Gin, Bin) included in the image data.

The $\alpha$ calculation module 42 determines, when displaying a one-frame image, candidates for the expansion coefficient $\alpha$ (or the inverse $1/\alpha$ of $\alpha$) for each pixel PX included in the display area 20, and determines the expansion coefficient $\alpha$ of the one frame based on the determined candidates. For example, the $\alpha$ calculation module 42 calculates a first candidate for the expansion coefficient $\alpha$ based on the input values (Rin, Gin, Bin) of a certain pixel PX, calculates a second candidate for the expansion coefficient $\alpha$ based on statistical information SI, and determines one of the first and second expansion coefficients $\alpha$ as a candidate for the expansion coefficient $\alpha$ of the pixel PX.

The statistical information SI indicates the relationship between the saturation (chroma) of each of the colors indicated by the input values (Rin, Gin, Bin) and an expansion coefficient $\alpha_0$ (or inverse $1/\alpha_0$). The expansion coefficient $\alpha_0$ is an expansion coefficient temporarily calculated from the input values (Rin, Gin, Bin) of each pixel PX. In each embodiment, the $\alpha$ calculation module 42 produces statistical information SI1 for the input values (Rin, Gin, Bin) of a color included in the first color area A1, statistical information SI2 for the input values (Rin, Gin, Bin) of a color included in the second color area A2, statistical information SI3 for the input values (Rin, Gin, Bin) of a color included in the third color area A3, and statistical information SI4 for the input values (Rin, Gin, Bin) of a color included in the fourth color area A4.

Figure 6:
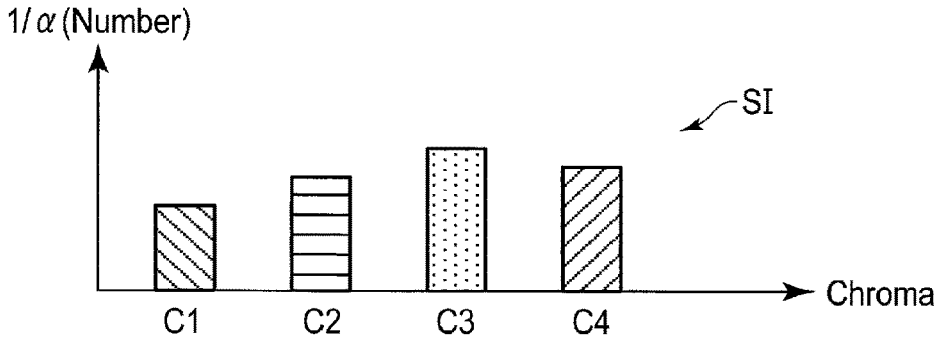
FIG. 6 is a graph showing a data structure example of statistical information.

FIG. 6 shows a data structure example of statistical information SI (SI1 to SI4). The statistical information SI of this example includes four counts C1 to C4. The count C1 is a statistical value based on $1/\alpha_0$ calculated from input values (Rin, Gin, Bin) that indicate colors having saturation levels less than a threshold SH1. The count C2 is a statistical value based on $1/\alpha_0$ calculated from input values (Rin, Gin, Bin) that indicate colors having saturation levels not less than the threshold SH1 and less than a threshold SH2. The count C3 is a statistical value based on $1/\alpha_0$ calculated from input values (Rin, Gin, Bin) that indicate colors having saturation levels not less than the threshold SH2 and less than a threshold SH3. The count C4 is a statistical value based on $1/\alpha_0$ calculated from input values (Rin, Gin, Bin) that indicate colors having saturation levels not less than the threshold SH3.

The output calculation module 43 produces the output values (Rout, Gout, Bout, Wout) of each pixel PX, based on input values obtained after being subjected to the inverse $\gamma$ correction by the correction module 40, and based on the expansion coefficient $\alpha$ calculated by the correction module 40. The component Wout corresponding to one of the output values is generated by replacing the common portions of the components Rin, Gin and Bin extended using the expansion coefficient $\alpha$, as described above using FIG. 3, for example. Further, the components Rout, Gout and Bout as the other output values can be generated by subtracting a value corresponding to the component Wout from each of the components Rin, Gin and Bin extended by the expansion coefficient $\alpha$.

Furthermore, when the above-described normalization is performed on the input values (Rin, Gin, Bin), the output calculation module 43 converts the generated output values (Rout, Gout, Bout, Wout) into 8-bit data. Yet further, the output calculation module 43 performs, on the output values (Rout, Gout, Bout, Wout), a $\gamma$ correction using the same $\gamma$ value (=2.2) as that used for the $\gamma$ correction performed on the initial input values (Rin, Gin, Bin).

In addition, for the calculation of, for example, expansion coefficients $\alpha$ and $\alpha_0$ based on input values (Rin, Gin, Bin) and the calculation of the output values (Rout, Gout, Bout, Wout), the methods disclosed in JP 2014-139647 A, JP 2015-82024 A, JP 2014-191338 A, JP 2014-155024 A, JP 2014-186245 A, etc. can be appropriately employed.

As described above, a great amount of throughput is needed to generate output values including a value corresponding to a W component, based on input values including no value corresponding to the W component. In view of this, in each embodiment described below, the signal processor 4 reduces the load of processing by selectively performing the following process steps (1) and (2):

(1) First process step of calculating candidates for the expansion coefficient $\alpha$, based on the input values (Rin, Gin, Bin) of a pixel PX whose input values (Rin, Gin, Bin) are not substantially the same between a first frame and a second frame subsequent thereto; and (2) Second process step of calculating no candidates for the expansion coefficient $\alpha$ in association with a pixel PX whose input values (Rin, Gin, Bin) are substantially the same between the first frame and the second frame subsequent thereto, and of using candidates calculated in the first frame for the expansion coefficient $\alpha$ of the pixel PX, as candidates for the expansion coefficient $\alpha$ of the pixel PX calculated in the second frame.

Embodiments including specific examples of the first and second process steps will be described below.

First Embodiment

Figure 7:
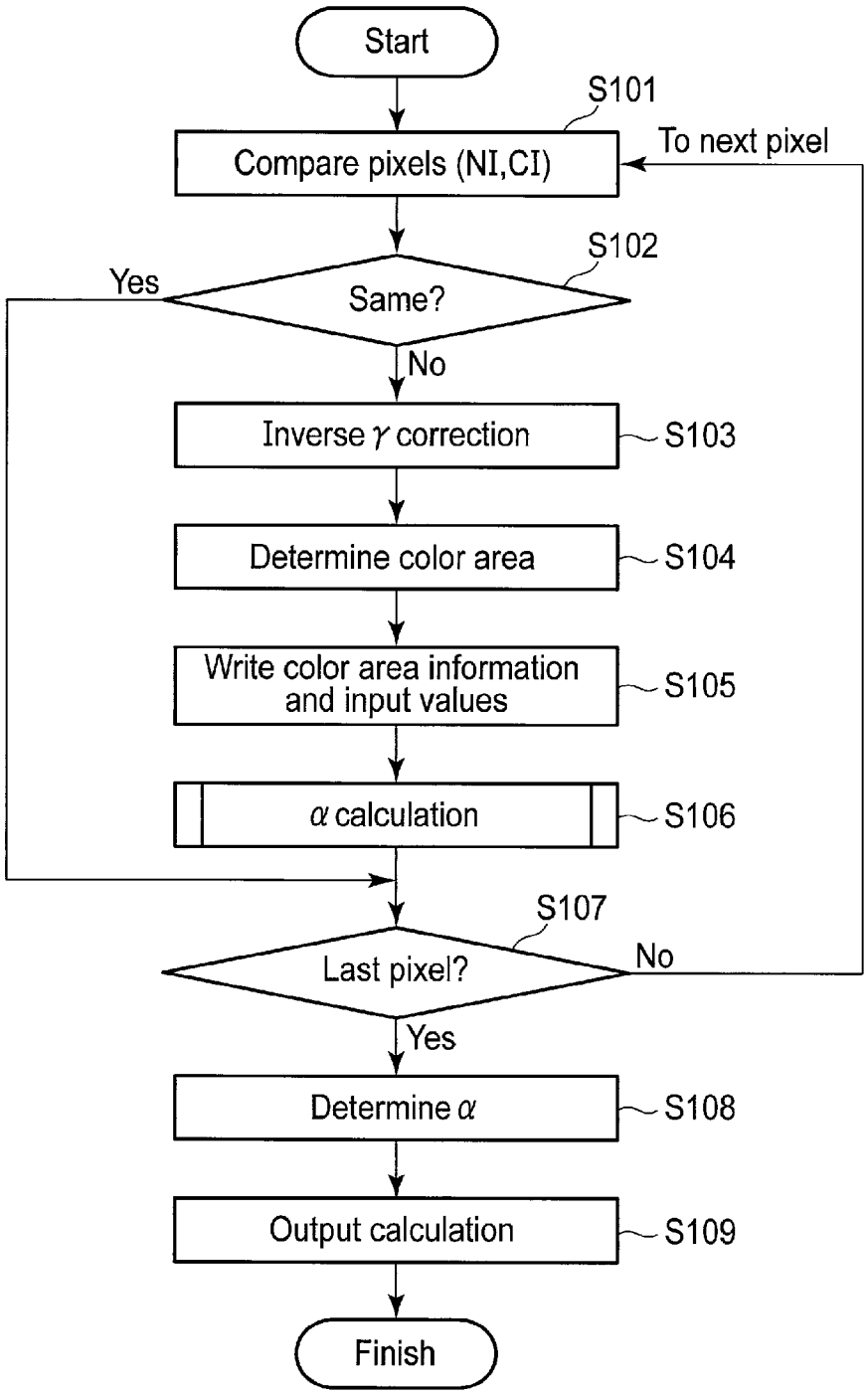
FIG. 7 is a flowchart showing processing executed by a signal processor according to a first embodiment.

FIG. 7 is a flowchart showing processing performed by the signal processor 4 according to a first embodiment. The processing of this flowchart corresponds to processing for calculating the output values (Rout, Gout, Bout, Wout) of each pixel PX in one frame.

First, in association with a certain pixel PX, the signal processor 4 compares input values (Rin, Gin, Bin) in a first frame (CI) currently displayed, with input values (Rin, Gin, Bin) in a second frame (NI) to be subsequently displayed (step S101). The pixel PX whose input values have been compared will hereinafter be referred to as a target pixel PX.

Next, the signal processor 4 determines whether the input values (Rin, Gin, Bin) of the target pixel PX are substantially the same between the first and second frames (step S102). For instance, the signal processor 4 determines that the input values (Rin, Gin, Bin) of the target pixel PX are substantially the same between the first and second frames, if the components Rin in the first and second frames are identical to each other, the components Gin in the first and second frames are identical to each other, and the components Bin in the first and second frames are identical to each other.

Alternatively, the signal processor 4 may determine that the input values (Rin, Gin, Bin) are substantially the same between the first and second frames, if the difference between the component values Rin in the first and second frames is not more than a threshold, the difference between the component values Gin in the first and second frames is not more than a threshold, and the difference between the component values Bin in the first and second frames is not more than a threshold. For instance, these thresholds are fixed values or variables falling within a range of not less than 5% to not more than 20% of the respective components Rin, Gin and Bin. If the thresholds are set as variables, they may be calculated for each pixel PX, based on the hue and saturation represented by the input values (Rin, Gin, Bin) in the first or second frame, or may be selected using a prepared data table. Alternatively, the thresholds may be calculated from image data as mentioned above, or may be beforehand defined in a memory. As an example, each threshold may be set to assume a lower value when a corresponding input value represents a lower saturation and a hue closer to red than to yellow.

If it is determined that the input values (Rin, Gin, Bin) are not substantially the same between the first and second frames (NO in step S102), the correction module 40 performs the above-described inverse γ correction on the input values (Rin, Gin, Bin) in the second frame of the target pixel PX (step S103).

After that, the color-area processing module 41 determines to which one of the above-mentioned first to fourth color areas A1 to A4 the color indicated by the input values (Rin, Gin, Bin) belongs (step S104). The color-area processing module 41 writes, to the frame buffer 50, color area information that indicates the determined color area, and the input values (Rin, Gin, Bin) of the target pixel PX obtained after the inverse γ correction (step S105). It should be noted that when processing on the second frame starts, the input values (Rin, Gin, Bin) of each pixel PX in the first frame, obtained after the inverse γ correction, and corresponding color area information, are already written to the frame buffer 50. In step S105, the color-area processing module 41 replaces the input values (Rin, Gin, Bin) and color area information of the target pixel PX in the first frame, with the input values (Rin, Gin, Bin) and color area information of the target pixel PX in the second frame.

After step S105, the α calculation module 42 performs α calculation processing (step S106). In the α calculation processing, candidates for the expansion coefficient α of the target pixel PX is calculated. The α calculation processing will be described later in detail, using FIG. 8.

If it is determined in step S102 that the input values (Rin, Gin, Bin) of the target pixel PX are substantially the same between the first and second frames (YES in step S102), the signal processor 4 does not execute steps S103 to S106. In this case, the candidates for the expansion coefficient α of the target pixel PX in the first frame are directly used as candidates for the expansion coefficient α of the pixel PX in the second frame. Moreover, the input values (Rin, Gin, Bin) of the pixel PX, obtained by inverse γ correction in the first frame and written to the frame buffer 50, are directly used for calculating the output values (Rout, Gout, Bout, Wout) of the pixel PX in the second frame.

If it is determined after step S106 or in step S102 that the input values (Rin, Gin, Bin) are substantially the same between the first and second frames, the signal processor 4 determines whether the target pixel PX is the last pixel in the second frame (step S107). In other words, the signal processor 4 determines whether all pixels PX in the second frame have been regarded as target pixels. If it is determined that the target pixel PX is not the last pixel (No in step S107), the signal processor 4 executes steps S101 to S106, using a pixel PX that is not yet regarded as a target pixel.

If all pixels have been regarded as target pixels (Yes in step S107), the α calculation module 42 determines the expansion coefficient α of the second frame, based on candidates for the expansion coefficient α of each pixel PX (step S108). For example, the α calculation module 42 determines a lowest value among the expansion coefficient α candidates as the expansion coefficient α of the second frame. Other various methods, such as a method of determining the average of all candidates or the average of part of the candidates as the expansion coefficient α of the second frame, can be employed.

After step S108, the output calculation module 43 performs output calculation processing (step S109). In the output calculation processing, the output calculation module 43 extends the input values (Rin, Gin, Bin) of each pixel PX written to the frame buffer 50, using the expansion coefficient α determined in step S108. Furthermore, the output calculation module 43 produces the output values (Rout, Gout, Bout, Wout) of each pixel PX, based on the extended components Rin, Gin and Bin of each pixel PX, as described above using FIG. 3. After that, the output calculation module 43 performs γ correction on the output values (Rout, Gout, Bout, Wout) of each pixel PX.

At this time, the signal processor 4 completes processing of one frame. The signal processor 4 outputs, to the display panel 2, a signal indicating the thus-produced output values (Rout, Gout, Bout, Wout) of each pixel. Based on this signal, the display panel 2 displays an image of the second frame in the display area 20.

A description will now be given of the α calculation processing in step S106.

Figure 8:
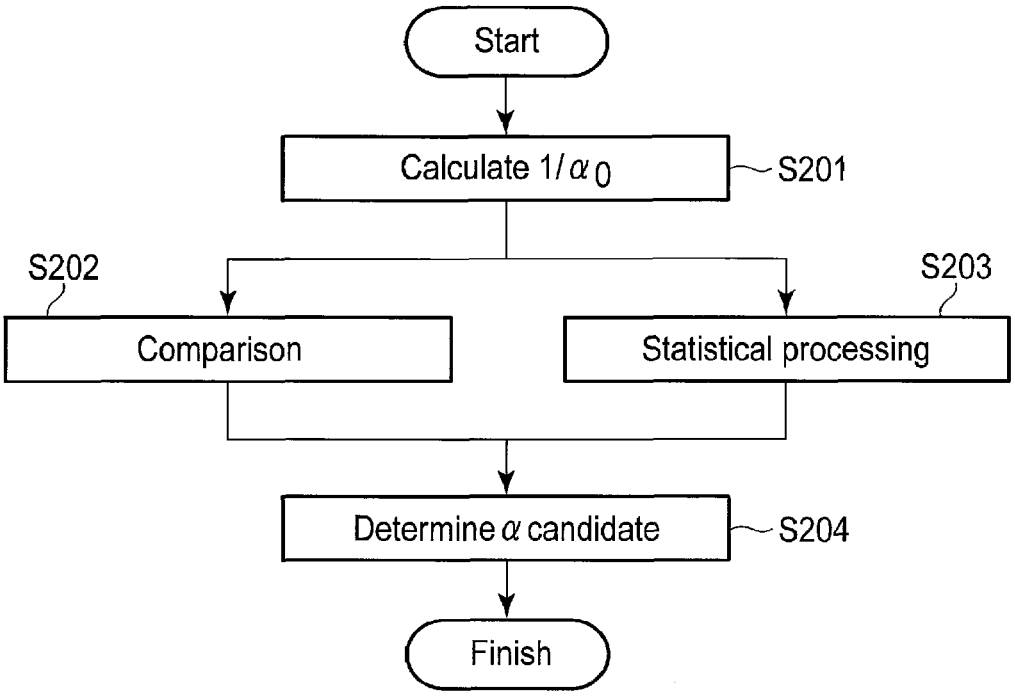
FIG. 8 is a flowchart showing an example of $\alpha$ calculation processing.

FIG. 8 is a flowchart showing an example of α calculation processing. First, the α calculation module 42 calculates the inverse $1/\alpha_0$ of an expansion coefficient $\alpha_0$, based on the input values (Rin, Gin, Bin) of a target pixel PX written to the frame buffer 50 (step S201). The α calculation module 42 may calculate the expansion coefficient $\alpha_0$ in place of the inverse $1/\alpha_0$. For example, the expansion coefficient $\alpha_0$ included in the inverse $1/\alpha_0$ calculated in step S201 enables the luminance of a color indicated by the input values (Rin, Gin, Bin) to be set to a maximum value within the expression possible range of the display panel, if the input values (Rin, Gin, Bin) of the target pixel PX written to the frame buffer 50 are multiplied by the expansion coefficient $\alpha_0$.

After step S201, the α calculation module 42 performs comparison processing (step S202) for determining a first candidate for the expansion coefficient α, and statistical processing (step S203) for determining a second candidate for the expansion coefficient α.

In the comparison processing, the α calculation module 42 selects a highest value (namely, a lowest expansion coefficient $\alpha_0$) from the inverses $1/\alpha_0$ calculated so far in step S201 (including $1/\alpha_0$ calculated in step S201 of the last loop) in association with the pixels PX regarded as processing targets. The expansion coefficient $\alpha_0$ in the selected inverse $1/\alpha_0$ corresponds to the first candidate. For example, for a pixel PX having input values (Rin, Gin, Bin) substantially the same between the first and second frames and hence not subjected to step S202, an inverse $1/\alpha_0$ calculated in step S201 associated with the pixel PX in the first frame or a frame before the first frame may be used for the selection of the first candidate.

On the other hand, in the statistical processing, the α calculation module 42 updates statistical information SI that is included in statistical information items S11 to S14 and corresponds to color area information of a target pixel PX written to the frame buffer 50.

Figure 9:
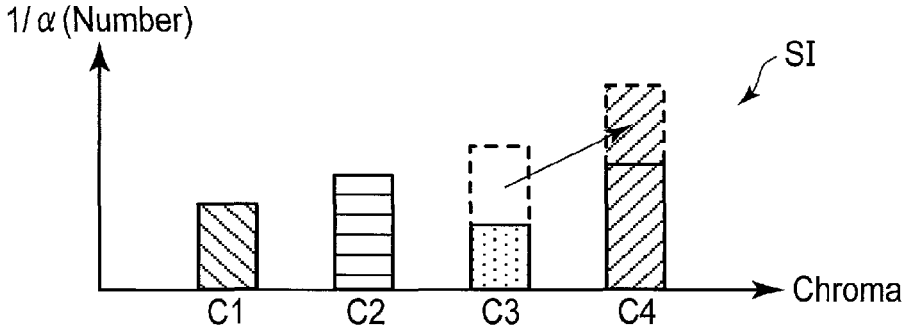
FIG. 9 is a view for describing update of statistical information.

Referring now to FIG. 9, a description will be given of the update of the statistical information SI. The α calculation module 42 compares the saturation of a color indicated by the input values (Rin, Gin, Bin) of a target pixel PX in the second frame, with the above-mentioned thresholds SH1 to SH3, thereby selecting one of counts C1 to C4 corresponding to the saturation and increasing the selected count. The value of increase is set to, for example, a fixed value. Alternatively, the value of increase may be weighted in accordance with, for example, the saturation or the inverse $1/\alpha_0$. Yet alternatively, in the case of pixels having input values that are not substantially the same in the second frame, a statistic value may be calculated based on $1/\alpha_0$ and added to the value of increase. In the case of pixels in the first frame, a statistical value may be calculated based on color area information and input values stored in the frame buffer 50, and subtracted from a statistical value in a corresponding color area.

Furthermore, the α calculation module 42 decreases a count corresponding to the saturation of a color indicated by the input values (Rin, Gin, Bin) of a target pixel PX in the first frame. As well as the above-mentioned value of increase, the value of decrease may be constant or weighted. As an example, the value of increase is identical to the value of decrease in each of the counts C1 to C4. FIG. 9 shows an example where the input values (Rin, Gin, Bin) of a target pixel PX in the second frame correspond to the count C4, and the input values (Rin, Gin, Bin) of the target pixel PX in the first frame correspond to the count C3. As shown, the count C3 is decreased, while the count C4 is increased.

After thus updating the statistical information SI corresponding to the color area of the target pixel PX, the α calculation module 42 determines a second candidate for the expansion coefficient α, based on the statistical information SI. For example, the α calculation module 42 selects the second candidate based on the counts C1 to C4. More specifically, the α calculation module 42 selects, as the second candidate, one of the defaults prepared for the respective counts C1 to C4. In this case, for example, a default corresponding to the highest value among the counts C1 to C4 included in the updated statistical information SI may be set as the second candidate. The α calculation module 42 may determine the second candidate by another method, such as a method of calculating the second candidate, based on the counts C1 to C4 and a predetermined formula.

The method of determining the second candidate using the statistical information SI is not limited to the above-described one. For instance, the counts C1 to C4 of the statistical information SI may correspond to respective areas defined in association with $1/\alpha_0$. In this case, in the statistical processing of step S203, a count corresponding to, for example, an area, to which $1/\alpha_0$ calculated in step S201 belongs, is added. To the count of a certain $1/\alpha_0$ area, all counts of areas having $1/\alpha_0$ values greater than that of the certain area may be added. Further, in each of the counts C1 to C4, a representative value and a threshold are defined for $1/\alpha$. After that, a greatest count included in counts that have come to be higher than a threshold is determined to be a second candidate. The number of counts included in statistical information SI is not restricted to four. Further, in statistical information SI corresponding to color areas, the number of counts may differ.

After steps S202 and S203, the α calculation module 42 determines a final candidate for the expansion coefficient α associated with the target pixel PX, based on the first and second candidates (step S204). For example, the α calculation module 42 determines one of the first and second candidates, which has a lower value, as the final candidate for the expansion coefficient α. Another method of determining, for example, the average of the first and second candidates as the final candidate may be employed. Step S204 is the final step of the α calculation processing according to the flowchart.

As described above, in the liquid crystal display 1 of the embodiment, the α calculation processing of step S106 is omitted in association with pixels having substantially the same input values (Rin, Gin, Bin) between the first and second frames. As a result, the processing load of the signal processor 4 can be reduced, and the speed of calculation processing can be increased.

Furthermore, in the embodiment, the processing (for example, inverse γ processing) in steps S103 to S105 is also omitted, along with the α calculation processing. This further reduces the processing load of the signal processor 4.

In the case of, for example, a still image, each pixel has the same input values (Rin, Gin, Bin) between the first and second frames. Accordingly, in this case, the processing load of the α calculation processing can be reduced by 100%. That is, the whole processing load of the signal processor 4 can be reduced by about 50% or more. Further, even in the case of a moving picture where the number of pixels having their input values (Rin, Gin, Bin) substantially unequal between the first and second frames is approximately ½ of the entire pixels, it is expected that the whole processing load of the signal processor 4 can be reduced by about 30%.

Moreover, as described above, if it is determined that the input values between the first and second frames are substantially the same when the difference in each input value, i.e., each component Rin, Gin or Bin, between the first and second frames is not more than a threshold, the number of pixels PX determined to be substantially the same will increase. Thus, the processing load can be further reduced. This determination method is effective when employing, for example, FRC (Frame Rate Control) in which the number of display colors is increased utilizing, for example, persistence effect of vision.

If the processing load is high, there is a case where the operation of the signal processor 4 cannot be realized through software processing by a general-purpose processor. In this case, it is necessary to constitute the signal processor 4 using an IC dedicated to signal processing for the liquid crystal display 1. In contrast, if the processing load is reduced as in the embodiment, the signal processor 4 can be constituted by the general-purpose processor. Therefore, the manufacturing cost and development period of the liquid crystal display 1 can be reduced. Further, reduction of the processing load leads to reduction of the power consumption of the liquid crystal display 1.

The embodiment provides various advantages, as well as the above-mentioned ones.

Second Embodiment

Figure 10:
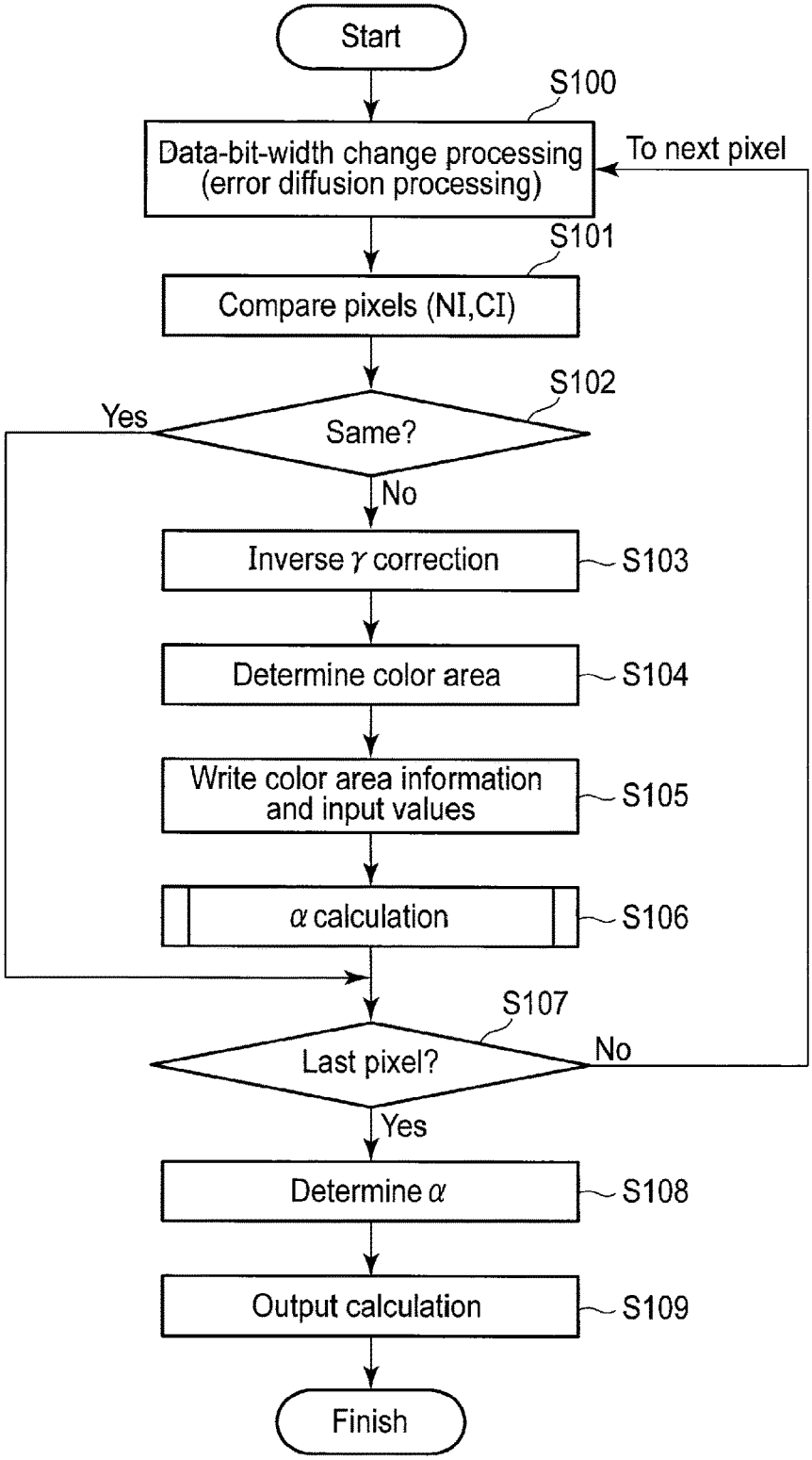
FIG. 10 is a flowchart showing processing executed by a signal processor according to a second embodiment.

A second embodiment will be described. FIG. 10 is a flowchart showing processing executed by a signal processor 4 according to the second embodiment. In the second embodiment, the same steps as those in the first embodiment will be denoted by the same reference numbers, and will be appropriately omitted.

The second embodiment assumes a case where the second bit width of each output component (Rout, Gout, Bout, gout) is smaller than the first bit width of each input component (Rin, Gin, Bin).

The flowchart of FIG. 10 differs from that of FIG. 7 in that in the former, step S100 directed to data-bit-width changing processing is provided before step S101. In the data-bit-width changing processing, the signal processor 4 changes the width of each component (Rin, Gin, Bin) of a target pixel from a first bit width to a second bit width. In general, if the bit width is reduced, an error will occur. This error may cause degradation of image quality, such as appearance of a pseudo outline on a display image, which is not included in an image indicated by original image data. To avoid it, the data-bit-width changing processing includes error diffusion processing.

In the error diffusion processing, the signal processor 4 diffuses, into a pixel PX around a certain pixel PX, an error resulting from a reduction in the bit width of a component (Rin, Gin, Bin) of the certain pixel PX. For example, if the first bit width is 8 bits and the second bit width is 6 bits, the input values (Rin, Gin, Bin) of the pixel PX around the certain pixel PX are corrected in accordance with an error having occurred because the bit width of a component of the certain pixel PX is reduced by two bits.

Various methods can be adopted as error diffusion techniques. For instance, an error resulting from reduction of the bit width of an input component (Rin, Gin, Bin) of a certain pixel PX may be multiplied by a preset coefficient, and the resultant value may be added to the correcting input value (Rin, Gin, Bin) of a pixel PX adjacent to the certain pixel PX. Moreover, regularity of diffusion may be eliminated by changing the above-mentioned coefficient for each pixel PX using a random number.

Processing after step S101 is the same as that of the first embodiment. However, the input values (Rin, Gin, Bin) to be processed after step S101 are those obtained after the data-bit-with changing processing.

In the second embodiment described above, even if an input component (Rin, Gin, Bin) differs from an output component (Rout, Gout, Bout, Wout) in bit width, deterioration of image quality can be prevented. Further, the second embodiment can provide the same advantages as those of the first embodiment by a sequence of processing performed on input components (Rin, Gin, Bin) having their bit widths changed by the data-bit-width changing processing.

Third Embodiment

Figure 11:
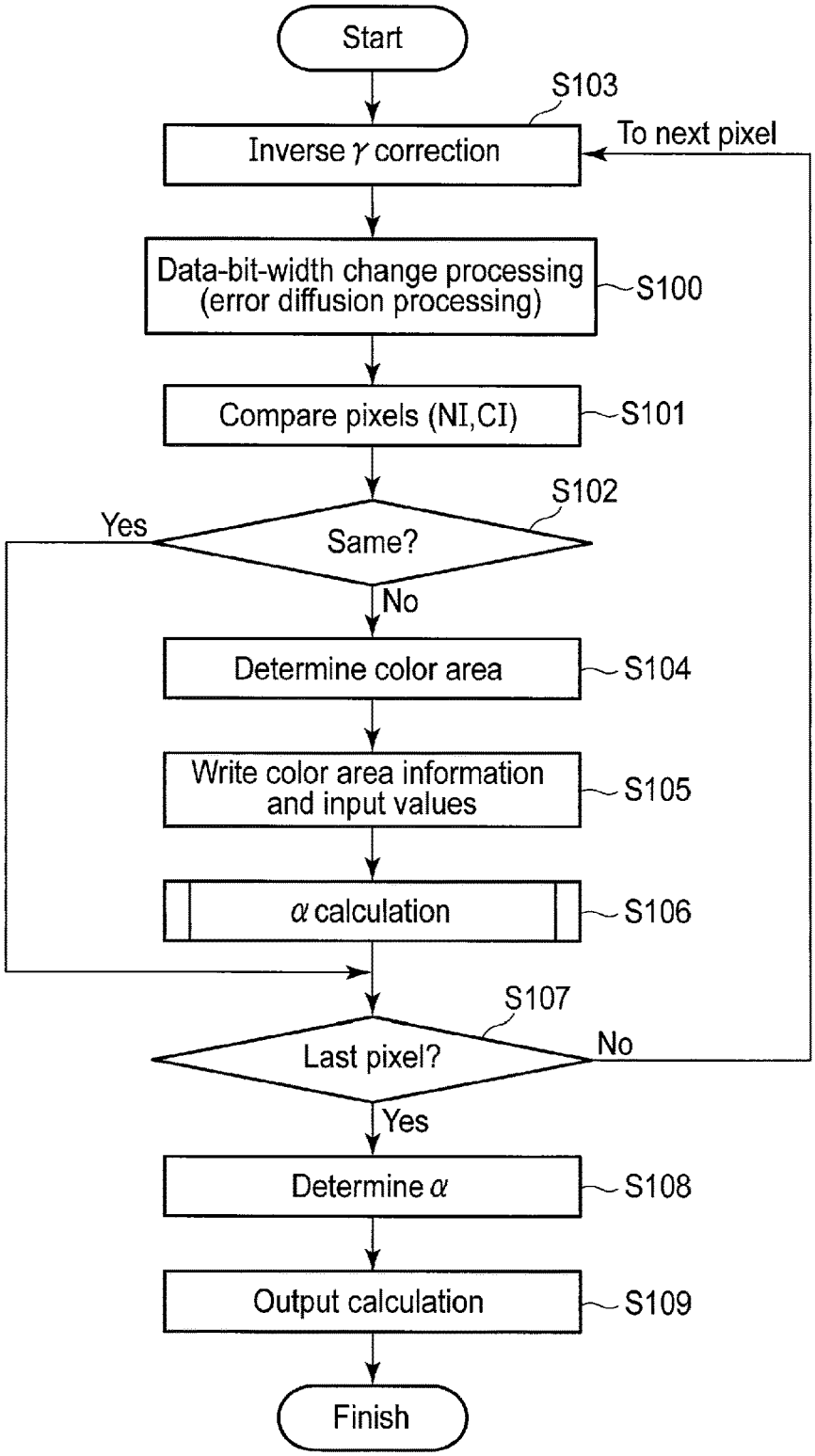
FIG. 11 is a flowchart showing processing executed by a signal processor according to a third embodiment.

A third embodiment will be described. FIG. 11 is a flowchart showing processing executed by a signal processor 4 according to a third embodiment. In the third embodiment, elements similar to those of the first and second embodiments are denoted by corresponding reference numbers, and no detailed description will be given thereof.

The flowchart of FIG. 11 differs from that of FIG. 10 in that in the former, inverse γ correction in step S103 of FIG. 10 is executed before the data-bit-width changing processing of step S100. That is, in the third embodiment, input values (Rin, Gin, Bin) are first subjected to the inverse γ correction, and the resultant values (Rin, Gin, Bin) are subjected to the data-bit-width changing processing.

If the inverse γ correction is performed after changing the bit width of an input value (Rin, Gin, Bin), an error may occur between the corrected input value and an original input value outside the signal processor 4 and not subjected to the γ correction. In contrast, in the third embodiment, since the data-bit-width conversion processing can be performed after accurately returning, to the original input value, the input value (Rin, Gin, Bin) to the signal processor 4, occurrence of an error in a corresponding output value (Rout, Gout, Bout, Wout) can be reduced. In addition, the third embodiment can provide the same advantages as those of the first and second embodiments.

Fourth Embodiment

A fourth embodiment will be described. The first embodiment is directed to an example where it is determined whether the input values (Rin, Gin, Bin) of each pixel are substantially the same between frames. In contrast, in the fourth embodiment, it is determined whether the input values (Rin, Gin, Bin) of each block formed of a plurality of pixels are substantially the same.

Figure 12:
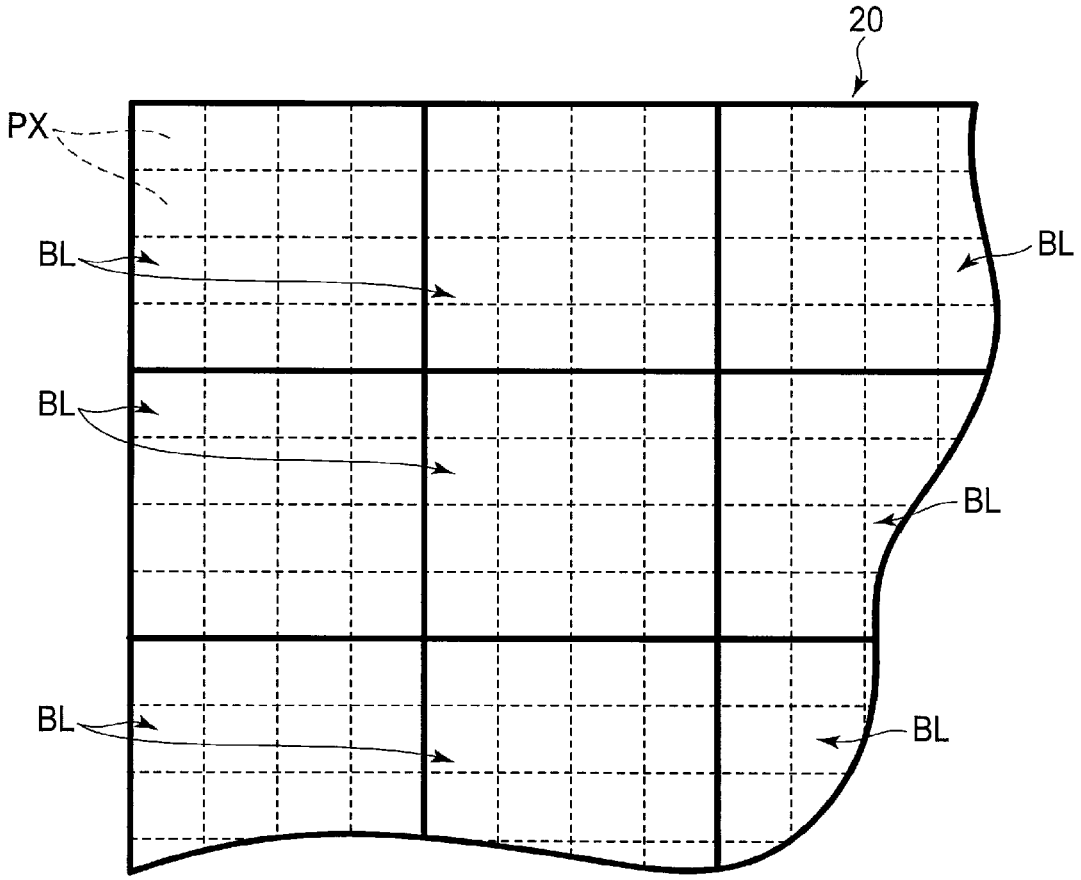
FIG. 12 is a view for describing the concept of a fourth embodiment.

FIG. 12 is a view for explaining the concept of a determination method according to the fourth embodiment, and shows a part of pixels PX included in the display area 20. In the display area 20, blocks BL each including a predetermined number of pixels PX are defined. In the example of FIG. 12, each block BL comprises 16 pixels PX arranged in a matrix of four rows and four columns. However, the numbers of columns, rows and total pixels PX, which constitute one block BL, are arbitrary.

The signal processor 4 produces an examination value for each block BL, and determines whether the examination value is substantially the same between first and second frames (step S102). As examination values, checksums for respective blocks EL can be used, for example. Specifically, the signal processor 4 produces total sum values Rsum1, Gsum1 and Bsum1 by summing up the input values Rin, Gin and Bin of pixels PX included in the first frame of each block BL, respectively. Similarly, the signal processor 4 produces total sum values Rsum2, Gsum2 and Bsum2 by summing up the input values Rin, Gin and Bin of pixels PX included in the second frame of each block BL, respectively. If the Rsum1 is equal to the Rsum2, the Gsum1 is equal to the Gsum2, and the Bsum1 is equal to the Bsum2, the signal processor 4 determines that the input values (Rin, Gin, Bin) of each pixel PX included in this block BL are substantially the same between the first and second frames.

Alternatively, the signal processor 4 may determine that the input values (Rin, Gin, Bin) of each pixel PX included in this block BL are substantially the same between the first and second frames, if the difference between the Rsum1 and the Rsum2 is not more than a threshold, the difference between the Gsum1 and the Gsum2 is not more than a threshold, and the difference between the Bsum1 and the Bsum2 is not more than a threshold. These thresholds may be fixed values or variables corresponding to the hue or saturation, as in the first embodiment.

Further, all of the total sum values Rin, Gin and Bin may be used as examination values, or one or two of them may be used as examination values. Furthermore, the sum of the total sum values Rin, Gin and Bin can also be used as an examination value.

Each pixel PX having input values (Rin, Gin, Bin) determined, as described above, to be substantially the same between the first and second frames is subjected to, for example, processing of steps S103 to S106 shown in the flowchart of FIG. 7. In contrast, the processing of steps S103 to S106 is omitted for each pixel determined not to be substantially the same.

In addition, in the fourth embodiment, checksums are used to perform determinations as to whether the blocks BL are substantially the same. However, the determination as to whether the pixels or blocks are substantially the same may be performed by applying an error detection method, such as Cyclic Redundancy Check (CRC). In the case of applying CRC, for example, a remainder obtained when a bit string indicating the input values (Rin, Gin, Bin) of each pixel PX included in one block BL is divided by a predetermined numerical value can be used as the above-mentioned examination value.

Since in the fourth embodiment, the determination as to whether the input values (Rin, Gin, Bin) are substantially the same between the first and second frames can be collectively performed in association with a plurality of pixels PX, the processing load of the signal processor 4 can be further reduced. As well as this advantage, the fourth embodiment can provide the same advantages as those of the first and second embodiments.

Although some embodiments of the present invention have been described above, they are merely examples and do not limit the scope of the invention. Various omissions, various replacements and/or various changes may be made in the embodiments without departing from the scope of the invention. Some structural elements of different embodiments may be combined appropriately. The embodiments and their modifications are included in the scope of the invention, namely, in the inventions recited in the claims and equivalents thereof.

For instance, the process steps shown in each of the flowcharts of FIGS. 7, 10 and 11 may be changed in their turns. Further, another process step may be added to the flowcharts, or a part of the process steps may be omitted therein. Chroma changing processing of changing, for example, the saturation of a color, represented by the input values (Rin, Gin, Bin), in accordance with the characteristics of the display panel 2 in order to improve the image quality of the display image, is regarded as an additional processing example.

In each embodiment, the statistical information items SI1 to SI4 are not successively produced frame by frame, but are maintained over sequential frames while partially updated in step S203. Accordingly, accuracy may be gradually degraded because of, for example, an error occurring in each calculation step. To avoid this, the statistical information items SI1 to S14 may be periodically refreshed. As an example of refreshment, the count of each of the statistical information items SI1 to SI4 may be reset to zero every predetermined number of frames, thereby producing new statistical information items SI1 to SI4.

Each embodiment is directed to the case where each pixel PX comprises sub-pixels SPX corresponding to red, green, blue and white. However, each pixel PX may comprise sub-pixels of other colors in place of these sub-pixels SPX, or may comprise another sub-pixel in addition to the sub-pixels SPX. The technical idea disclosed in each embodiment is also applicable to a display device equipped with such pixels PX as the above.

Some display device examples that can be obtained from the disclosures will be described below.

[1] A display device comprising:

a display panel comprising pixels which each include a first sub-pixel, a second sub-pixel, a third sub-pixel and a fourth sub-pixel;

a processor configured, when displaying an image of one frame, to determine candidates for an expansion coefficient for a respective pixel, to determine the expansion coefficient for the one frame, based on a respective one of the determined candidates, to calculate output values of the respective pixel corresponding to the first, second, third and fourth sub-pixels, based on the determined expansion coefficient and input values of the respective pixel corresponding to the first, second and third sub-pixels, and to output the output values to the display panel, wherein the processor is configured to calculate a candidate for the expansion coefficient in association with a second frame of the respective pixel, when the input values of the respective pixel are not substantially the same between a first frame and the second frame subsequent to the first frame; and the processor is configured to calculate no candidate for the expansion coefficient in association with the second frame of the respective pixel, when the input values of the respective pixel are substantially the same between the first and second frames.

[2] The display device according to the above item [1], wherein when the input values of the respective pixel are substantially the same between the first and second frames, the processor is configured to determine, as a candidate for the expansion coefficient corresponding to the second frame, a candidate for the expansion coefficient calculated in the first frame.

[3] The display device according to the above item [1], wherein when the input values of the respective pixel are substantially the same between the first and second frames, a difference between input values in the first and second frames, corresponding to the first sub-pixel, is less than a threshold, a difference between input values in the first and second frames, corresponding to the second sub-pixel, is less than a threshold, and a difference between input values in the first and second frames, corresponding to the third sub-pixel, is less than a threshold.

[4] The display device according to the above item [3], wherein the processor is configured to set the thresholds, based on at least one of hue and saturation of a color represented by the input values.

[5] The display device according to the above item [1], wherein the processor is configured to determine, as the expansion coefficient corresponding to the second frame, a lowest value among the candidates for the expansion coefficient determined for the respective pixel.

[6] The display device according to the above item [1], wherein the processor is configured to determine, as the expansion coefficient corresponding to the second frame, an average of all or a part of the candidates for the expansion coefficient determined for the respective pixel in association with the second frame.

[7] The display device according to the above item [1], wherein the processor is configured to produce an examination value for a respective block, the respective block including a plurality of pixels, and to determine that input values of the pixels included in the block are substantially the same between the first and second frames, when the examination values of the block of the first and second frames are substantially the same.

[8] The display device according to the above item [7], wherein the examination value includes at least one of a sum of input values corresponding to the first sub-pixels of the pixels included in the respective block, a sum of input values corresponding to the second sub-pixels of the pixels included in the respective block, and a sum of input values corresponding to the third sub-pixels of the pixels included in the respective block.

[9] The display device according to the above item [1], wherein the processor is configured to produce statistical information indicating a relationship between saturation of a color indicated by the input values and the expansion coefficient; and when the input values of the respective pixel are not substantially the same between the first and second frames, the processor is configured to determine a first candidate for the expansion coefficient, based on the input values, to determine a second candidate for the expansion coefficient, based on the statistical information, and to select one of the first and second candidates as a candidate for the expansion coefficient for the respective pixel.

[10] The display device according to the above item [9], wherein the processor is configured to select, as the candidate for the expansion coefficient for the respective pixel, one of the first and second candidates determined for the respective pixel having input values not substantially the same between the first and second frames, the one of the first and second candidates having a lower value.

[11] The display device according to the above item [9], wherein the processor is configured to select, as the candidate for the expansion coefficient for the respective pixel, an average of the first and second candidates determined for the respective pixel having input values not substantially the same between the first and second frames.

[12] The display device according to the above item [9], wherein the processor is configured to produce the statistical information for respective areas defined in a predetermined color space; and the processor is configured to determine the second candidate for the respective pixel having input values not substantially the same between the first and second frames, based on one of the statistical information corresponding to an area of the areas, to which a color represented by the input values belongs.

[13] The display device according to the above item [1], wherein each of the first to third sub-pixels corresponding to the input values has a first bit width;

each of the first to fourth sub-pixels corresponding to the output values has a second bit width smaller than the first bit width;

the processor is configured to change, to the second bit width, the first bit width of each of the first to third sub-pixels corresponding to the input values; and the processor is configured to determine whether the input values are substantially the same between the first and second frames, based on the first to third sub-pixels changed to the second bit width.

[14] The display device according to the above item [13], wherein the processor is configured to correct input values of another pixel adjacent to a pixel having the first to third sub-pixels changed from the first bit width to the second bit width, based on an error resulting from the change from the first bit width to the second bit width.

[15] The display device according to the above item [14], wherein the input values are γ corrected;

the processor is configured to change, to the second bit width, the first bit width of the first to third sub-pixels corresponding to the γ corrected input values;

the processor is configured to determine whether the input values are substantially the same between the first and second frames, based on the first to third sub-pixels changed to the second bit width, and the processor is configured to subject, to inverse γ correction, the input values of the second frame corresponding to the first to third sub-pixels of the pixel having input values not substantially the same between the first and second frames.

[16] The display device according to the above item [14], wherein the input values are γ corrected;

the processor is configured to inversely γ correct the input values;

the processor is configured to change, to the second bit width, the first bit width of the first to third sub-pixels corresponding to the inversely γ corrected input values; and the processor is configured to determine whether the input values are substantially the same between the first and second frames, based on the first to third sub-pixels changed to the second bit width.

What is claimed is:

1. A display device comprising:

a display panel comprising pixels which each includes a first sub-pixel, a second sub-pixel, a third sub-pixel and a fourth sub-pixel;

a processor configured, when displaying an image of one frame, to determine candidates for an expansion coefficient for a respective pixel, to determine an expansion coefficient for the one frame, based on one of the determined candidates, to calculate output values of the respective pixel corresponding to its first, second, third and fourth sub-pixels, based on the determined expansion coefficient for the one frame and input values of the respective pixel corresponding to its first, second and third sub-pixels, and to output the output values of the respective pixel to the display panel, wherein the processor is configured to calculate candidates for an expansion coefficient in association with a second frame of first pixels whose input values are not substantially the same between a first frame and the second frame subsequent to the first frame;

the processor is configured to calculate no candidate for an expansion coefficient in association with the second frame of second pixels whose input values are substantially the same between the first and second frames, and to determine, as candidates for the expansion coefficient in association with the second frame of the second pixels, candidates for an expansion coefficient of the second pixels calculated in the first frame;

the processor is configured to determine an expansion coefficient for the second frame based on the candidates of the first and second pixels, and the processor is configured to classify pixels of the display panel into the first pixels or the second pixels based on:

a difference between input values in the first and second frames, corresponding to the first sub-pixels of the second pixels, is less than a first threshold, a difference between input values in the first and second frames, corresponding to the second sub-pixels of the second pixels, is less than a second threshold, a difference between input values in the first and second frames, corresponding to the third sub-pixels of the second pixels, is less than a third threshold, and the first threshold, the second threshold, and the third threshold are all individually settable, the first threshold is a fixed value or a variable falling within a range of not less than 5% to not more than 20% of the input value corresponding to the first sub-pixels of the second pixels in the first frame, the second threshold is a fixed value or a variable falling within a range of not less than 5% to not more than 20% of the input value corresponding to the second sub-pixels of the second pixels in the first frame, and the third threshold is a fixed value or a variable falling within a range of not less than 5% to not more than 20% of the input value corresponding to the third sub-pixels of the second pixels in the first frame.

2. The display device according to claim 1, wherein the processor is configured to set the first, second and third thresholds, based on at least one of hue and saturation of a color represented by the input values of the respective pixels.

3. The display device according to claim 1, wherein the processor is configured to determine, as the expansion coefficient corresponding to the second frame, a lowest value among the candidates for the expansion coefficient determined for the first and second pixels in association with the second frame.

4. The display device according to claim 1, wherein the processor is configured to determine, as the expansion coefficient corresponding to the second frame, an average of all or a part of the candidates for the expansion coefficient determined for the first and second pixels in association with the second frame.

5. The display device according to claim 1, wherein the processor is configured to produce an examination value for a respective block, the respective block including a plurality of pixels, and to determine that input values of the plurality of pixels included in the block are substantially the same between the first and second frames, when the examination values of the block of the first and second frames are substantially the same.

6. The display device according to claim 5, wherein the examination value includes at least one of a sum of input values corresponding to the first sub-pixels of the plurality of pixels included in the respective block, a sum of input values corresponding to the second sub-pixels of the plurality of pixels included in the respective block, and a sum of input values corresponding to the third sub-pixels of the plurality of pixels included in the respective block.

7. The display device according to claim 1, wherein the processor is configured to produce statistical information indicating a relationship between saturation of a color indicated by the input values of the respective pixel and the expansion coefficient of the respective pixel; and the processor is configured to determine a first candidate for the expansion coefficient of the respective pixel, based on the input values of the respective pixel, to determine a second candidate for the expansion coefficient of the respective pixel, based on the statistical information, and to select one of the first and second candidates as a candidate for an expansion coefficient for the first pixels.

8. The display device according to claim 7, wherein the processor is configured to select, as the candidate for the expansion coefficient for the first pixels, one of the first and second candidates determined for the first pixels having input values not substantially the same between the first and second frames, the one of the first and second candidates having a lower value.

9. The display device according to claim 7, wherein the processor is configured to select, as the candidate for the expansion coefficient for the first pixel, an average of the first and second candidates determined for the first pixel having input values not substantially the same between the first and second frames.

10. The display device according to claim 7, wherein the processor is configured to produce the statistical information for respective areas defined in a predetermined color space; and the processor is configured to determine the second candidate for the first pixels having input values not substantially the same between the first and second frames, based on one of the statistical information corresponding to an area of the areas, to which a color represented by the input values of the respective pixel belongs.

11. The display device according to claim 1, wherein each of the first to third sub-pixels corresponding to the input values of the respective pixel has a first bit width;

each of the first to fourth sub-pixels corresponding to the output values of the respective pixel has a second bit width smaller than the first bit width;

the processor is configured to change, to the second bit width, the first bit width of each of the first to third sub-pixels corresponding to the input values of the respective pixel; and the processor is configured to determine whether the input values of the respective pixel are substantially the same between the first and second frames, based on the first to third sub-pixels changed to the second bit width.

12. The display device according to claim 11, wherein the processor is configured to correct input values of another pixel adjacent to a pixel having the first to third sub-pixels changed from the first bit width to the second bit width, based on an error resulting from the change from the first bit width to the second bit width.

13. The display device according to claim 12, wherein the input values of the respective pixel are γ corrected;

the processor is configured to change, to the second bit width, the first bit width of the first to third sub-pixels corresponding to the γ corrected input values of the respective pixel;

the processor is configured to determine whether the input values of the respective pixel are substantially the same between the first and second frames, based on the first to third sub-pixels changed to the second bit width, and the processor is configured to subject, to inverse γ correction, the input values of the second frame corresponding to the first to third sub-pixels of the first pixels having input values not substantially the same between the first and second frames.

14. The display device according to claim 12, wherein the input values of the respective pixel are γ corrected;

the processor is configured to inversely γ correct the input values of the respective pixel;

the processor is configured to change, to the second bit width, the first bit width of the first to third sub-pixels corresponding to the inversely γ corrected input values of the respective pixel; and the processor is configured to determine whether the input values of the respective pixel are substantially the same between the first and second frames, based on the first to third sub-pixels changed to the second bit width.

15. The display device according to claim 1, wherein the first threshold, the second threshold, and the third threshold are variable, and the first threshold, the second threshold, and the third threshold are respectively calculated for each pixel, based on hue and saturation represented by the input values of the respective pixel in the first frame or the second frame.

* * * * *